United States Patent [19]

Hansen et al.

[11] Patent Number: 4,911,489

[45] Date of Patent: Mar. 27, 1990

[54] T-HANDLE LATCH

[75] Inventors: Randall C. Hansen, Lake Forest; Christopher C. Lee, Gurnee, both of Ill.

[73] Assignee: A. L. Hansen Manufacturing Company, Waukegan, Ill.

[21] Appl. No.: 304,970

[22] Filed: Feb. 1, 1989

[51] Int. Cl.[4] ..... E05C 9/04

[52] U.S. Cl. ..... 292/336.3; 292/7; 292/DIG. 60

[58] Field of Search ..... 292/202, 341.18, 341.19, 292/DIG. 60, 336.3, 347, 7; 70/461, 139; 411/184, 185; 403/61

[56] References Cited

U.S. PATENT DOCUMENTS

| | | | |
|---|---|---|---|
| 722,162 | 3/1903 | St. Louis | 292/7 |
| 1,060,484 | 4/1913 | Newton | 292/DIG. 60 X |
| 2,057,866 | 10/1936 | Weber | 49/465 X |
| 2,768,015 | 10/1956 | Manchester | 70/461 X |
| 3,708,191 | 1/1973 | Hegedus | 292/347 X |

FOREIGN PATENT DOCUMENTS

| | | | |
|---|---|---|---|
| 11551 | of 1907 | United Kingdom | 411/184 |

*Primary Examiner*—Richard E. Moore

*Attorney, Agent, or Firm*—Willian Brinks Olds Hofer Gilson & Lione

[57] ABSTRACT

A T-handle latch in which a housing is designed for reception in an opening of an item to be latched. A shank of a handle is rotationally disposed in the housing, and an actuating member of the latch is fixed on the end of the shank. The shank may be received in a shank-receiving opening of the actuating member, the opening being elongate so that the actuating member may be fixed in any of a plurality of discrete transverse positions with respect to the shank. Keying elements on the shank and in the shank-receiving opening define the discrete positions and are useful in achieving initial adjustment of the latch, in preventing the latch from slipping out of adjustment during use, and in helping to prevent relative rotation of the shank and the actuating member. Return springs bias the handle toward a neutral, home position. The return springs may be housed completely within the body of the latch, thereby protecting them from accidential damage, dislodging or loss during use, installation or shipping.

11 Claims, 3 Drawing Sheets

5
82
80
7
60
56
10
14
7
5

82
76
80
30
42
46
104
102
46
104
102
100
16
76

80
110
14
10
126
26
104
46
18
34
32
30
48
24
22
128
50
60
112
116
110

T-HANDLE LATCH

FIELD OF THE INVENTION

The current invention pertains to a latch and, in particular, to a T-handle latch.

DISCUSSION OF THE BACKGROUND

FIGS. 1–3 illustrate a known T-handle latch. Such latches are used for latching and locking a variety of doors, for example the tailgate of a pick-up truck. The latch comprises a housing 10, a handle 12 rotationally mounted within the housing 10, and a latch actuating member 40 mounted on the end of the handle for rotation therewith. The housing 10 is primarily intended for reception in an opening of an item to be latched, such as a door, and is fixed, in use, against rotation within the opening at a selected angular position.

The handle 12 comprises a grip 14 made up of wings 16 and a cylindrical portion 18. Extending from the grip 14 is a stepped shaft 20, including a first stepped portion 22, a second stepped portion 24, and a third stepped portion 26.

The third stepped portion 26 extends outwardly from the left end of the housing 10 as seen in FIG. 1, where it is received within an end cap 30. The end cap 30 is fixed against rotation with respect to the stepped shaft, as by lands 31 on the third stepped portion 26. End cap 30 also is fixed on the end of the shaft 20, as by a washer 32 and a screw 34. Alternatively, the end cap 30 can be pinned in place or may be held by a clip or a swaged part of the shaft.

It will be seen that the end cap 30 and stepped shaft 20 rotate as a unit within housing 10. Accordingly, the end cap 30 and stepped shaft 20 will be referred-to collectively as a shank of the handle 12.

The shank of the handle is received in shank receiving opening 42 of the actuating member 40. As seen in FIG. 2, the opening 42 is formed in part by straight side walls 44 that cooperate with lands 46 of the end cap 30, thereby helping to insure that the actuating member 40 will rotate when the shank of the handle is rotated. Positioning nut 50 is received on threads 48 of end cap 30, thereby retaining the actuating member 40 on the shank of the handle.

Lands 52 are formed on opposite sides of housing 10, these lands being designed to cooperate with similarly-shaped portions of the opening of the item to be latched in which the housing is received.

One end of a return spring 70 is received in an opening 72 of the actuating member 40. The other end of the return spring 70 is received in opening 74, formed in the housing 10. Return spring 70 is a tension spring, and serves to bias the rotation of the actuating member 40 and handle 12 to return to a neutral home position following the turning of the handle 12 by a user. Torsional coil springs have also been used.

For purposes of mounting the latch, a mounting nut 60 is received on threads 62 of the housing 10. In use, the item to be latched is held between rear face 54 of a flange 56 and front face 58 of mounting nut 60. It is generally difficult or impossible to mount the latch with positioning nut 50, latch actuating member 40 and mounting nut 60 mounted in place. For this reason, return spring 70 must often be disconnected from actuating member 40. If the opening in the item to be latched is sufficiently large, return spring 70 may be left connected to housing 10 during the insertion of the housing 10 into the opening. If not, return spring 70 must be disconnected from the housing 10.

The combination of housing 10 and attached handle 12 is then inserted into the opening, whereupon the mounting nut 60 is threaded onto the housing 10 until the housing is tightly secured to the item to be latched. Actuating member 40, return spring 70 and position nut 50 are then attached. In the past mounting clips have on occasion been used in place of the nut 60.

Various embodiments of actuating members are known. In the embodiment shown in FIGS. 1–3, actuating member 40 is provided with two working openings 76. Such openings are intended for the pivotal attachment of actuating rods or similar elements of latch hardware. In order to facilitate the attachment of such hardware, the actuating member 40 is designed so that it may be adjusted transversely with respect to the shank of the handle 12. For this purpose, as may be seen in FIG. 2, the shank receiving opening 42 has a length in a transverse direction (shown top to bottom in FIG. 2) that is greater than the width of the received portion of the shank as measured in the same direction. Thus, the actuating member 40 may slide transversely of the shaft during installation. Upon achieving a desired position, the position nut 50 may then be tightened, thereby adjusting the latch to the actuating rods or other latch hardware. The end cap is symmetrical to allow the actuating member 40 to be mounted on the shank in four different angular positions.

Although not shown in FIGS. 1–3, it is typical for a locking cylinder to be received in the handle 12 and extend into the stepped shaft 20, so that turning of a key will extend a locking member outwardly of the stepped shaft 20 to mate with a corresponding locking groove formed within the interior of housing 10.

The installation and use of a latch as described above presents a number of disadvantages.

The transverse positioning of the actuating member 40 with respect to the handle 12 is established by tightening the positioning nut 50 against the outside face of the actuating member 40. If the nut 50 becomes loose during use, the proper adjustment may be lost. In addition, the initial installation can be made more difficult by the ability of the actuating member 40 to slide freely transversely of the shank until such time as the nut 50 is tightened.

In another aspect, the exposed return spring 70 is subject to accidental damage or dislodging during use. As described above, it must be manipulated during installation. Furthermore, because it is a separate element, the return spring 70 is subject to loss even before installation, as during transportation, sale, and the like.

SUMMARY OF THE INVENTION

According to one aspect of the current invention, there is provided a T-handle latch in which the initial transverse positioning of the actuating member 40 during installation is easier, in which that positioning will not be lost once it has been achieved initially, and in which the rotational coupling between the shaft of the handle and the actuating member is enhanced. In particular, there is provided a T-handle latch including keying elements formed on the actuating member and the shank of the handle, the keying elements defining at least two discrete relative positions of the shank and the actuating member in a transverse direction of the latch, in which the keying elements comprise means for keying together the actuating member and the shank so as to prevent relative motion between the actuating member and the shank in the transverse direction.

According to another aspect of the current invention, there is provided a T-handle latch in which one or more return springs are housed within the body of the latch so that they need not be dealt with during installation and are protected from accidental damage, dislodging or loss during shipping, installation and use. In particular, there is provided a latch in which opposed surfaces formed in the housing and the handle form one or more spring-receiving openings therebetween, and in which at least one projection fixed on either the handle or the housing extends into the spring-receiving opening, such that relative rotation of the handle away from the home position causes movement of the first projection within the spring receiving opening to cause the storing of energy in the return spring.

DESCRIPTION OF THE PREFERRED EMBODIMENT

Figure 1:
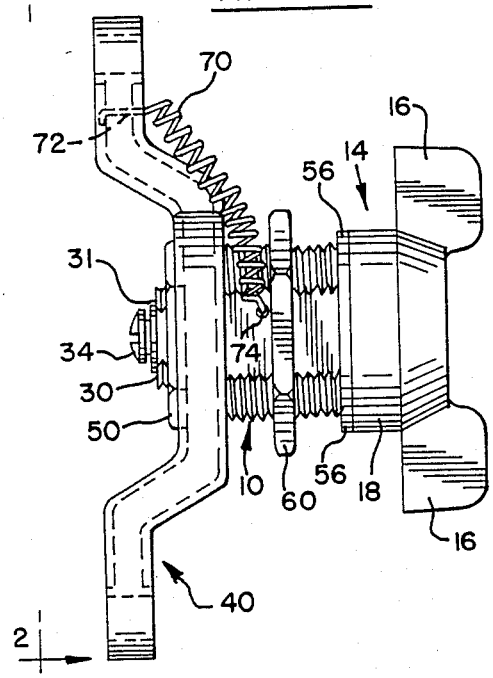
FIG. 1 PRIOR ART
FIG. 1 is a plan view of a known T-handle latch.
Figure 2:
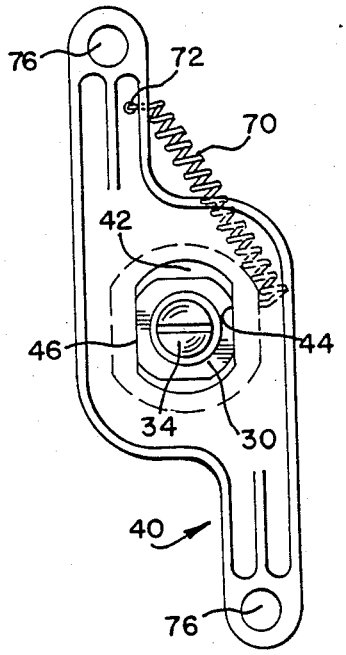
FIG. 2 PRIOR ART
FIG. 2 is a side view of selected elements of the latch of FIG. 1, illustrating the reception of the shank of the handle in the shank receiving opening of the actuating member, and taken along line 2—2 of FIG. 1.
Figure 3:
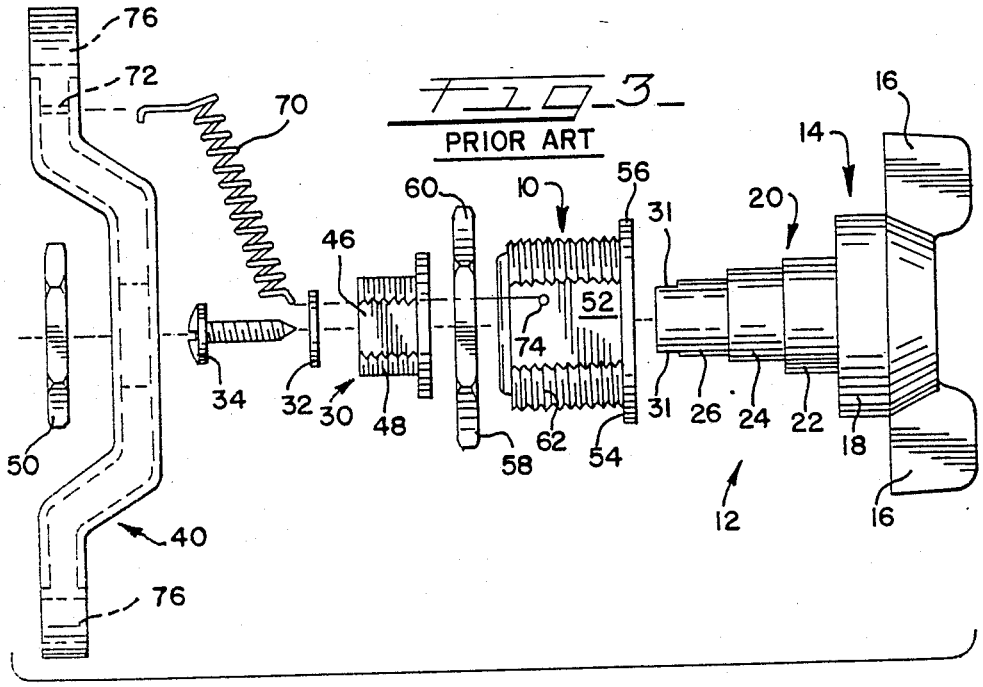
FIG. 3 PRIOR ART
FIG. 3 is an exploded view of the latch of FIGS. 1 and 2.
Figures 4, 5, 6:
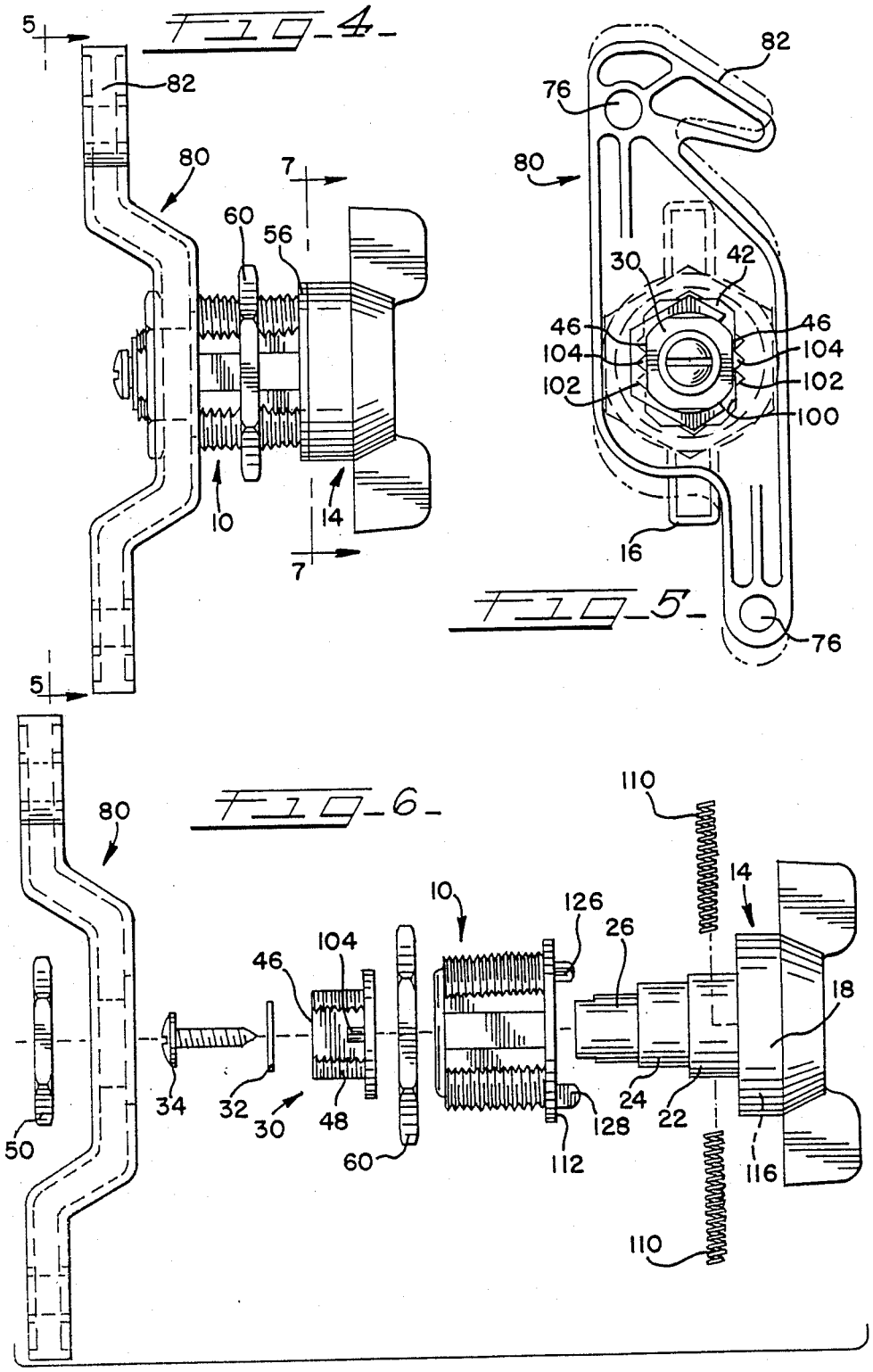
FIG. 4 is a plan view of a preferred embodiment of the T-handle latch of the current invention.
FIG. 5 is a side view taken on line 5—5 of FIG. 4, also showing an alternative embodiment of a latch actuating member.
FIG. 6 an exploded of the latch of FIG. 4.

FIGS. 4–6, illustrating the current invention, are roughly analogous to FIGS. 1–3 illustrating a known T-handle latch. The same reference numerals are used to illustrate identical or corresponding parts, where appropriate. Only the differences between the current invention and the latch of FIGS. 1–3 will be described in detail.

Initially, it will be noted that the actuating member 80 differs, among other respects, from the actuating member 40 by the provision of a camming surface 82. In operation, a non-illustrated portion of the latch may approach the actuating member 80 from the direction represented by the top of FIG. 5 and, by acting on camming surface 82, cause the actuating member 80 to rotate temporarily counterclockwise in the figure, thereby providing for automatic latching. A possible alternative use of actuating member 80 is illustrated by the provision of working openings 76 that may be used as described above in regard to actuating member 40.

Figure 8:
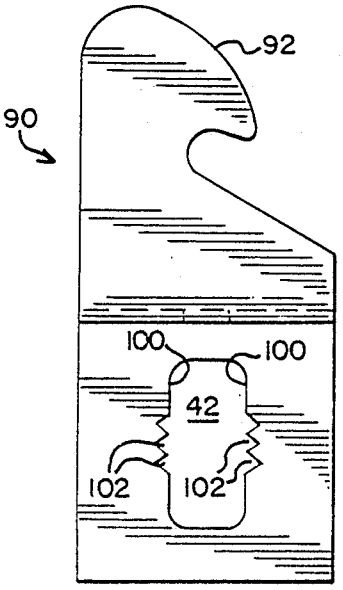
FIGS. 8 and 9, respectively, are an elevation and plan view of yet a further alternative embodiment of an actuating member, also illustrating a preferred form of keying members.
Figure 9:
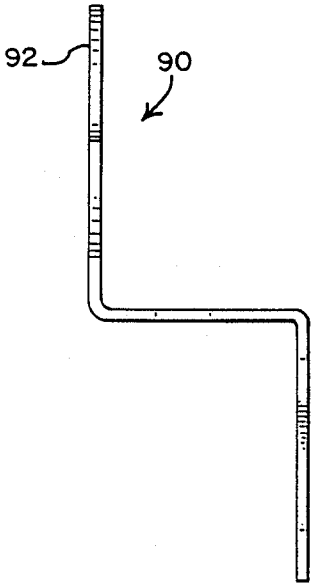

Yet a further embodiment of an actuating member is shown in FIGS. 8 and 9, wherein the working openings 76 are omitted, the actuating member 90 functioning by operation of arcuate camming surface 92.

The above-described overall configuration of camming surfaces and working openings form no part of the current invention. They are included for the purpose of illustrating that the current invention may be used with a variety of actuating members.

As shown in FIG. 5 but better seen in FIG. 8, an actuating member is provided with a shank receiving opening 42 having opposed side walls 100 that are generally straight and parallel. One of the side walls 100, preferably both of them, are interrupted by at least two and preferably three or more triangular notches 102. The notches 102 are linearly disposed and are separated from one another by at least one-eighth inch.

A ridge 104 having a generally triangular cross-section is formed in end cap 30. Preferably, two such ridges 104 are formed on opposite sides of end cap 30. It may be seen that end cap 104 is configured for reception in the notches 102 of the various types of actuating members.

FIG. 5 illustrates in solid line a first transverse position of the actuating member 80 with respect to the shank of the handle, and in phantom a second position of the actuating member. In the specific embodiment shown, three notches 102 are provided in each parallel side wall 100, according to which the ridges 104 and notches 102 define three discrete relative positions of the shank and the actuating member in a transverse direction of the latch. Naturally, in order to accommodate these positions, the width of the shank receiving opening 42 in the transverse direction is greater than the width of the received portion of the shank as measured in the same direction.

It may be seen that, when one of the available discrete positions has been selected and the positioning nut 50 tightened, the actuating member will be held more securely against transverse movement with respect to the shank than is the case with the known latch described above. Even during initial installation and adjustment, before the nut 50 is tightened finally, the temporary positioning afforded by the keying elements can be useful. Further, the mating of the keying elements serves as an additional means of helping to prevent relative rotation between the actuating member and the shank of the handle.

Figure 7:
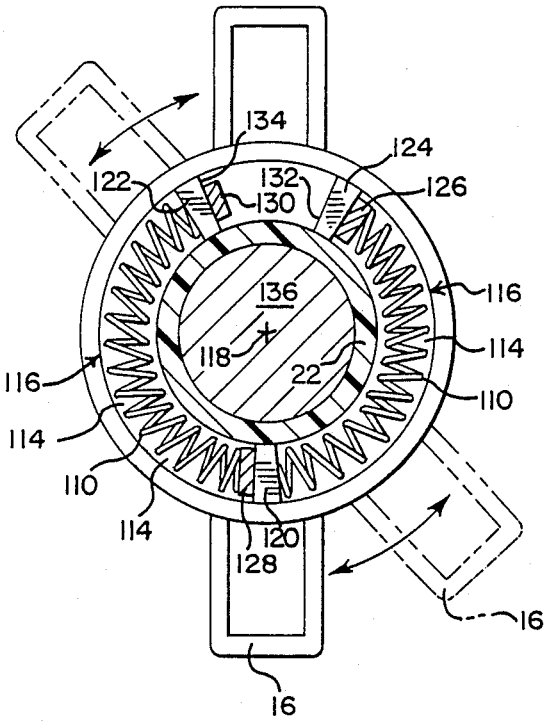
FIG. 7 is an elevational cross-section taken on line 7—7 of FIG. 4.

According to a second aspect of the current invention, at least one, and preferably more, return springs 110 are permanently received within the body of the latch. In the preferred embodiment, as shown in FIG. 7, two return springs 110 are received within cylindrical portion 18 (FIG. 6) of grip 14. For this purpose, opposed surfaces 112 of housing 10 and 114 of grip 14 form spring-receiving openings 116 therebetween. In this embodiment, the spring-receiving openings 116 are formed within the cylindrical portion 18 of grip 14.

Preferably, the springs 110 are compression springs, arcuately disposed generally about the axis of rotation 118 of the handle.

As shown in FIG. 7, the grip 14 comprises a first partition 120, a second partition 122, and a third partition 124. An end of one of the springs 110 is disposed in contact with the first partition 120, an end of the other spring 110 is disposed in contact with the second partition 122.

As shown in FIG. 6, a first projection 126 and a second projection 128 are fixed on housing 10 and extend to the right in the drawing. Projections 126,128 extend into the spring-receiving openings 116. Because of the location of the plane on which FIG. 7 is taken (see FIG. 4), the first and second projections 126,128 appear in cross-section in FIG. 7. In particular, it may be seen that a first one of the springs 110 is disposed between the first partition 120 and the first projection 126, the other spring 110 being disposed between the second partition 122 and the second projection 128.

Also shown in FIG. 7 is a stop 130 which, like the first and second projections 126,128, is fixed on the housing 10 and extends from the end face 112 into the cylindrical portion 18 of the grip. The stop 130 does not appear in FIG. 6, because it is hidden by first projection 126. As will be explained in more detail below, stop 130 interacts with a first limit surface 132, which is a surface of third partition 124, and a second limit surface 134, which is a surface of second partition 122.

The neutral, home position of the handle with respect to the housing is shown in solid line in FIG. 7, with a displaced position of the wings 16 being shown in phantom. It will be recalled that the housing 10 remains fixed during operation of the latch, and the handle and associated shank turn. For this reason, in FIG. 7, during turning of the handle the stop 30 and the first and second projections 126,128 will remain fixed, everything else in the drawing tending to turn counterclockwise as the compression springs 110 absorb energy.

Accordingly, in the neutral, home position illustrated, the compression springs 110 are shown biasing the handle in the clockwise direction, thereby tending to push the second partition 122 against the stop 130, to push the first partition 120 against the second projection 128, and tending to push the third partition 124 against the first projection 126.

When the handle is turned, for example to the position shown in phantom, the handle will move in the counterclockwise sense. Third partition 124 will approach the stop 130, first partition 120 will approach the first projection 126, thereby compressing one of the springs, and the second partition 122 will approach second projection 128, thereby compressing the other spring. It may be noted that this operation may also be viewed as one in which the first and second projections 126,128 move within the spring-receiving openings 116, depending upon the way one chooses to describe it.

Upon continued rotation, first limit surface 132 will contact stop 130, thereby preventing further relative rotation of the handle with respect to the housing.

Upon release of the handle, the handle will tend to return to the solid line position shown in FIG. 7, in which the second limit surface 134 abuts the stop 130, the third partition 124 abuts the first projection 126, and the first partition 120 abuts the second projection 128. Given usual manufacturing tolerances, it is likely that the return of the handle into the home position will be halted predominantely by one of the three above-noted abutments. The relative contribution of each said abutment to defining the home position is not critical.

One additional important characteristic should be noted, best illustrated in FIG. 7. The hatched area generally designated 136 at the center of the handle is sufficiently large for the reception of a lock cylinder, if desired. Accordingly, even though the current invention provides for housing the return springs completely within the body of the latch, there remains sufficient room within the handle for the provision of a lock cylinder.

Of course, it should be understood that a wide range of changes and modifications can be made to the preferred embodiment described above. For example, grips not having wings 16 (such as circular grips) may be used. It may be possible to house the springs within a compartment of the housing 10 instead of the handle. Tension springs or torsion springs instead of compression springs 110 may be used with only slight modification. It might also be possible to design a mechanism for housing the springs 110 generally between the handle and the housing. In such case, that portion of the mechanism nearest the handle may be thought of as an extension of the handle, and that portion of the mechanism nearest the housing may be thought of as an extension of the housing. In other words, handles of two or more parts, and housings of two or more parts, may be used. Additionally, the spring receiving openings 116 can be formed in the housing 10 and the projections 126, 128 can be formed on the grip 16.

In view of the above, it is intended that the foregoing detailed description be regarded as illustrative rather than limiting, and that it be understood that it is the following claims, including all equivalents, which are intended to define the scope of this invention.

We claim:

1. In a latch of the type having:

a housing for reception in an opening of an item to be latched, said housing extending generally in a longitudinal direction of said latch;

a handle comprising a grip disposed proximate a first end of said housing and a shank rotationally disposed in said housing and extending longitudinally thereof;

a latch actuating member affixed on an end of said shank proximate a second end of said housing such that rotation of said grip causes rotation of said actuating member about a longitudinal axis of said shank for the operation of the latch; and adjustment means for allowing the affixation of said actuating member on said shank in different transverse positions of said actuating member, the improvement comprising:

keying elements formed on said actuating member and said shank, said keying elements defining at least two discrete relative positions of said shank and said actuating member in a transverse direction of said latch, said keying elements comprising means for keying together said actuating member and said shank so as to prevent relative motion between said actuating member and said shank in said transverse direction.

2. The improvement of claim 1, said actuating member having formed therein a shank-receiving opening, said shank being received in said opening, said opening having a width in a transverse direction that is greater than a width of the received portion of said shank as measured in the same direction, wherein said at least two transverse positions correspond to at least two different relative positions of said received portion of said shank with respect to said shank-receiving opening.

3. The improvement of claim 2, the actuating member having sidewalls defining said shank-receiving opening, said sidewalls being opposed to lateral sides of said shank, said keying elements being formed on at least one of said sidewalls of said actuating elements and at least one of said lateral sides of said shank.

4. The improvement of claim 1, said keying means comprising elements formed on said shank and on said actuating member, therebeing at least two of said elements on one of said shank and said actuating member, said at least two elements being disposed substantially in a straight line, there being at least one of said elements on the other of said shank and said actuating member.

5. In a latch of the type having:

a housing for reception in an opening of an item to be latched, said housing extending generally in a longitudinal direction of said latch;

a handle comprising a grip disposed proximate a first end of said housing and a shank rotationally disposed in said housing and extending longitudinally thereof along an axis of rotation; and a latch actuating member affixed on an end of said shank proximate a second end of said housing;

the improvement comprising:

a first arcuate recess formed in one of the housing and the handle and disposed between the housing and the handle, said first recess defined in part by a spring reaction surface;

a spring disposed in the first arcuate recess to bear against the spring reaction surface;

a second arcuate recess formed in said one of the housing and the handle concentric with the first recess and disposed between the housing and the handle, said second recess defined in part by a pair of stop surfaces;

first and second protrusions on the other of the housing and the handle, said first protrusion positioned to move in the first recess as the handle rotates with respect to the housing and to contact the spring to compress the spring against the spring reaction surface, said second protrusion positioned to move in the second recess between the stop surfaces such that the second protrusion limits rotational movement of the handle with respect to the housing.

6. The invention of claim 5 wherein the first and second recesses are both included in an elongated composite arcuate recess.

7. The invention of claim 6 wherein the spring reaction surface and one of the stop surfaces are arranged as opposed surfaces of a single partition extending across the composite recess, said partition dividing the composite recess into the first and second recesses.

8. The invention of claim 7 wherein the composite recess additionally defines a third arcuate recess, wherein a second spring is disposed in said third arcuate recess, and wherein the other of the housing and the handle defines a third protrusion positioned to move in the third recess to compress the second spring in response to rotation of the handle with respect to the housing.

9. The invention of claim 8 wherein the first, second and third recesses extend in a substantially closed circle centered on the axis of rotation.

10. In a latch of the type having:

a housing for reception in an opening of an item to be latched, said housing extending generally in a longitudinal direction of said latch;

a handle comprising a grip disposed proximate a first end of said housing and a shank rotationally disposed in said housing and extending longitudinally thereof along an axis of rotation; and a latch actuating member affixed on an end of said shank proximate a second end of said housing;

the improvement comprising:

an annular recess formed in one of the housing and the handle and centered on the axis of rotation, said recess segmented by at least two radially extending partitions into at least one spring receiving recess and a rotation limiting recess, said partitions defining a spring reaction surface at one end of the spring receiving recess and a pair of stop surfaces at respective rend of the rotation limiting recess.

a spring disposed in each of the spring receiving recesses;

at least first and second protrusions on the other of the housing and the handle, said first protrusion positioned to move in the spring receiving recess as the handle rotates with respect to the housing to contact the spring and to compress the spring against the spring reaction surface, said second protrusion positioned to move in the rotation limiting recess between extremes of rotational travel defined by the stop surfaces.

11. The invention of claim 10 wherein the at least two partitions comprise three partitions, wherein the at least one spring receiving recess comprises two spring receiving recesses, and wherein the at least first and second protrusions additionally comprise a third protrusion positioned to move in the other spring receiving recess and to compress the other spring in response to rotation of the handle with respect to the housing.

* * * * *

UNITED STATES PATENT AND TRADEMARK OFFICE

CERTIFICATE OF CORRECTION

PATENT NO. : 4,911,489

DATED : March 27, 1990

INVENTOR(S) : Randall C. Hansen et al.

It is certified that error appears in the above-identified patent and that said Letters Patent is hereby corrected as shown below:

In column 6, line 64, please delete "therebeing" and substitute therefor --there being--.

In claim 10, column 8, line 24, please delete "rend" and substitute therefor --ends--.

Signed and Sealed this

Nineteenth Day of May, 1992

*Attest:*

DOUGLAS B. COMER

*Attesting Officer*

*Acting Commissioner of Patents and Trademarks*